US010101131B2

(12) United States Patent
Hallquist et al.

(10) Patent No.: US 10,101,131 B2
(45) Date of Patent: Oct. 16, 2018

(54) ARMOR STRUCTURES

(71) Applicant: Sikorsky Aircraft Corporation, Stratford, CT (US)

(72) Inventors: Craig Hallquist, Portland, OR (US); Shawn Alexander, Battle Ground, WA (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 0 days.

(21) Appl. No.: 15/428,904

(22) Filed: Feb. 9, 2017

(65) Prior Publication Data

US 2017/0299346 A1 Oct. 19, 2017

Related U.S. Application Data

(60) Provisional application No. 62/294,383, filed on Feb. 12, 2016.

(51) Int. Cl.
*F41H 5/02* (2006.01)
*F41H 5/04* (2006.01)

(52) U.S. Cl.
CPC ..... *F41H 5/0485* (2013.01)

(58) Field of Classification Search
CPC ..... F41H 5/04; F41H 5/0471; F41H 5/0478; F41H 5/0492; F41H 5/0485; A41D 31/0055
USPC ..... 89/36.02, 36.05, 901–939
See application file for complete search history.

(56) References Cited

U.S. PATENT DOCUMENTS

| | | | | |
|---|---|---|---|---|
| 3,649,426 | A * | 3/1972 | Gates, Jr. | E04B 1/62 109/84 |
| 5,996,115 | A * | 12/1999 | Mazelsky | F41H 1/02 2/2.5 |
| 6,053,696 | A | 4/2000 | Roberts | |
| 6,185,738 | B1 * | 2/2001 | Sidebottom | F41H 1/02 2/102 |
| 7,520,205 | B1 * | 4/2009 | Colliflower | F41H 5/0421 109/80 |
| 8,382,033 | B2 | 2/2013 | Reece | |
| 8,491,835 | B2 | 7/2013 | Schmidt | |
| 8,549,803 | B1 | 10/2013 | Retzloff et al. | |
| 8,777,161 | B2 | 7/2014 | Pollock et al. | |
| 9,032,706 | B2 | 5/2015 | Marshall | |
| 2005/0193667 | A1 * | 9/2005 | Henry | F41H 5/0428 52/309.9 |

(Continued)

*Primary Examiner* — Samir Abdosh
(74) *Attorney, Agent, or Firm* — Cantor Colburn LLP

(57) ABSTRACT

A method for manufacturing armor includes coating a first side of a ballistics arresting core with a first shell layer to create a partially coated ballistics arresting core, placing the partially coated ballistics arresting core in a vacuum bag and depressurizing the vacuum bag and curing the partially coated ballistics arresting core in the depressurized vacuum bag to create a partially shelled ballistics arresting core. The method further includes removing the partially shelled ballistics arresting core from the vacuum bag, coating a second side of the partially shelled ballistics arresting core with a second shell layer to create a fully coated ballistics arresting core, placing the fully coated ballistics arresting core in a vacuum bag and depressurizing the vacuum bag, and curing the fully coated ballistics arresting core in the depressurized vacuum bag to create a fully shelled ballistics arresting core.

11 Claims, 2 Drawing Sheets

(56) References Cited

U.S. PATENT DOCUMENTS

| | | | | |
|---|---|---|---|---|
| 2007/0034074 | A1* | 2/2007 | Ravid | F41H 5/0492 89/36.02 |
| 2008/0092730 | A1* | 4/2008 | Hall | E04H 9/10 89/36.04 |
| 2008/0264244 | A1* | 10/2008 | Ravid | F41H 5/0428 89/36.02 |
| 2009/0282968 | A1* | 11/2009 | Colliflower | F41H 5/04 89/36.02 |
| 2012/0291621 | A1* | 11/2012 | Sayre | F41H 5/0421 89/36.02 |
| 2015/0323289 | A1* | 11/2015 | Seuk | F41H 1/02 89/36.05 |
| 2015/0362293 | A1 | 12/2015 | Strauss | |
| 2016/0231088 | A1* | 8/2016 | Blackmore | F41H 5/0471 |

* cited by examiner

ARMOR STRUCTURES

CROSS-REFERENCE TO RELATED APPLICATIONS

This application claims the benefit of and priority to U.S. Provisional Patent Application Ser. No. 62/294,383 filed Feb. 12, 2016, which is incorporated herein by reference in its entirety for all purposes.

BACKGROUND

1. Field

The present disclosure relates to armor, more specifically to armor structures and methods of making the same.

2. Description of Related Art

Certain lightweight materials used for armor are not very durable. High performance polyethylene (HPPE) is a layered composite that has a very weak inter-laminar strength and very soft resin system. Repeated flexing or impacts can significantly reduce the HPPE's ability to stop projectiles. The resin system used is also very susceptible to fluid damage and certain chemicals common to environments in which the armor is used (e.g., jet fuel in an aircraft).

Generally long, unbroken fibers are desired for composite parts. To this end conventional techniques include wrapping a core in a single sheet of composite in one concurrent layup and cure cycle. However, the resulting product suffers from strength and fluid resistance limitations and such products are prone to failure.

Such conventional methods and systems have generally been considered satisfactory for their intended purpose. However, there is still a need in the art for improved armor and methods of making armor. The present disclosure provides a solution for this need.

SUMMARY

A method for manufacturing armor includes coating a first side of a ballistics arresting core with a first shell layer to create a partially coated ballistics arresting core, placing the partially coated ballistics arresting core in a vacuum bag and depressurizing the vacuum bag and curing the partially coated ballistics arresting core in the depressurized vacuum bag to create a partially shelled ballistics arresting core. The method further includes removing the partially shelled ballistics arresting core from the vacuum bag, coating a second side of the partially shelled ballistics arresting core with a second shell layer to create a fully coated ballistics arresting core, placing the fully coated ballistics arresting core in a vacuum bag and depressurizing the vacuum bag, and curing the fully coated ballistics arresting core in the depressurized vacuum bag to create a fully shelled ballistics arresting core.

Coating a second side of the partially shelled ballistics arresting core can include partially overlapping the first shell layer with the second shell layer along an edge of the first shell layer to seal the ballistics arresting core within the first shell layer and the second shell layer. Partially overlapping the first shell layer can include overlapping the edge of the first shell layer at a side of the ballistics arresting core and/or within an aperture defined in the ballistics arresting core.

Coating the first shell layer and/or second shell layer can include using between two to six plies of material for the first shell layer and/or the second shell layer. The method can include cutting or stamping one or more apertures in the first shell layer and/or the second shell layer to correspond to one or more apertures in the ballistics arresting core.

The method can include trimming the first shell layer after curing the partially coated ballistics arresting core. In certain embodiments, the method can include trimming the second shell layer after curing the fully coated ballistics arresting core.

The first shell layer and/or the second shell layer can include fiber reinforced polymer or any other suitable material. In certain embodiments, the fiber reinforced polymer can include pre-impregnated carbon-fiber or any other suitable fiber (e.g., wet layup fiberglass, wet layup carbon-fiber).

The method can include coating the first shell layer and/or the second shell layer with one or more exterior coatings. The exterior coatings can include one or more of a non-skid coating or paint.

In accordance with at least one aspect of this disclosure, an item of armor includes a ballistics arresting core, a first shell layer disposed on a first side of the ballistics arresting core, and a second shell layer disposed on a second side of the ballistics arresting core such that the second shell layer partially overlaps the first shell layer at an edge of the first shell layer to seal the ballistics arresting core within the first shell layer and the second shell layer.

The second shell layer can overlap the first shell layer along the edge of the first shell layer at a side of the ballistics arresting core and/or within an aperture defined in the ballistics arresting core. The first shell layer and/or second shell layer can include between two to six plies of material.

The item of armor can include one or more apertures (e.g., holes and/or recesses) defined in the first shell layer and/or the second shell layer to correspond to one or more apertures in the ballistics arresting core, wherein walls that form the apertures are covered by the first shell layer and/or second shell layer. In certain embodiments, an edge of the first shell layer can include a beveled surface.

The first shell layer and/or the second shell layer can include fiber reinforced polymer. The fiber reinforced polymer can include pre-impregnated carbon-fiber, wet layup fiberglass, or any other suitable material.

The first shell layer and/or the second shell layer can include one or more exterior coatings. The exterior coatings include one or more of a non-skid coating or paint.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1A:
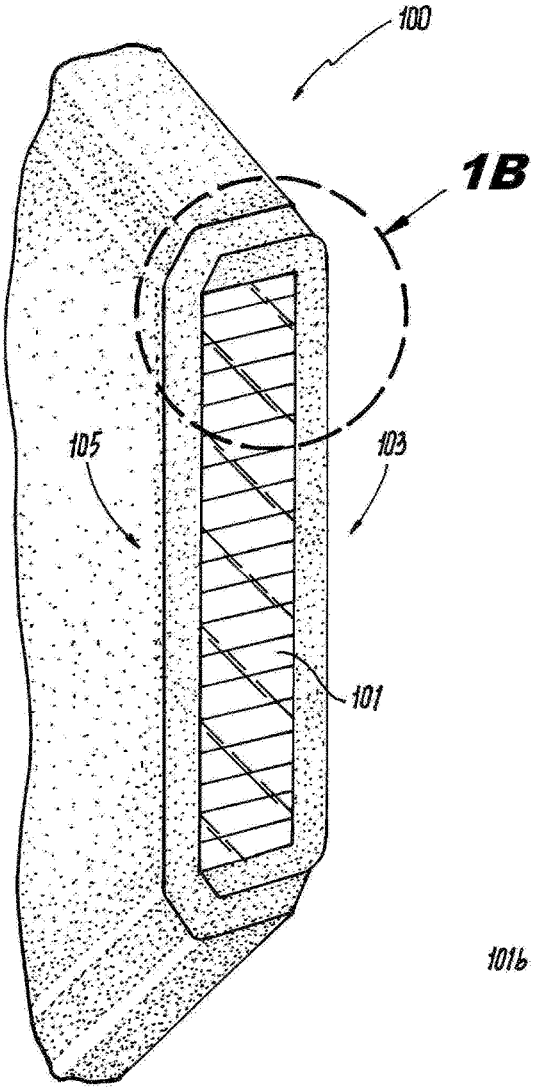
FIG. 1A is a perspective view of an embodiment of an item of armor in accordance with this disclosure, shown cut along a cross-section.

Reference will now be made to the drawings wherein like reference numerals identify similar structural features or aspects of the subject disclosure. For purposes of explanation and illustration, and not limitation, an illustrative view of a portion of an embodiment of an item of armor in accordance with the disclosure is shown in FIG. 1A and is designated generally by reference character 100. Other embodiments and/or aspects of this disclosure are shown in FIGS. 1B-3. The systems and methods described herein can be used to create improved armor.

Referring to FIG. 1A, an item of armor 100 includes a ballistics arresting core 101. The ballistics arresting core 101 can include any suitable material and structure (e.g., with one or more apertures) configured to stop projectiles (e.g., bullets) from passing therethrough and/or for any other suitable purpose (e.g., mounting to a helicopter). In certain embodiments, the ballistics arresting core 101 can include high performance polyethylene (HPPE). Any other suitable polymer (e.g., a suitable plastic), or any other suitable material or combination of materials is contemplated herein.

Figure 1B:
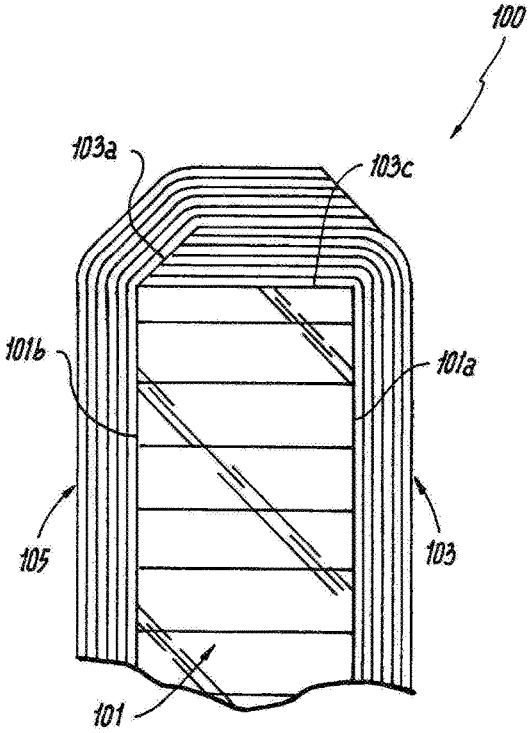
FIG. 1B is a cross-sectional view of an edge of the item of armor of FIG. 1, showing the second shell layer overlapping the first shell layer.

Referring to FIG. 1B, a first shell layer 103 is disposed on a first side 101*a* of the ballistics arresting core 101. A second shell layer 105 is disposed on a second side 101*b* of the ballistics arresting core 101 such that the second shell layer 105 partially overlaps the first shell layer 103 at an edge 103*a* of the first shell layer 103 to seal the ballistics arresting core 101 within the first shell layer 103 and the second shell layer 105.

As shown, the second shell layer 105 can overlap the first shell layer 103 along the edge 103*a* of the first shell layer 103 at a side 103*c* of the ballistics arresting core 101. In certain embodiments, the edge 103*a* of the first shell layer 103 can include a beveled surface as shown (e.g., formed by overlaying a plurality of plies of the same length and bending the plies around a corner of the ballistics arresting core 101).

The first shell layer 103 and/or second shell layer 105 can include between two to six plies of material. The first shell layer 103 and/or the second shell layer 105 can include a polymer (e.g., polyuria). In certain embodiments, the polymer can be fiber reinforced (e.g., using carbon-fiber, fiberglass, or any other suitable material). In certain embodiments, the fiber reinforced polymer can include pre-impregnated carbon-fiber or any other suitable fiber (e.g., wet layup carbon-fiber).

Figure 2:
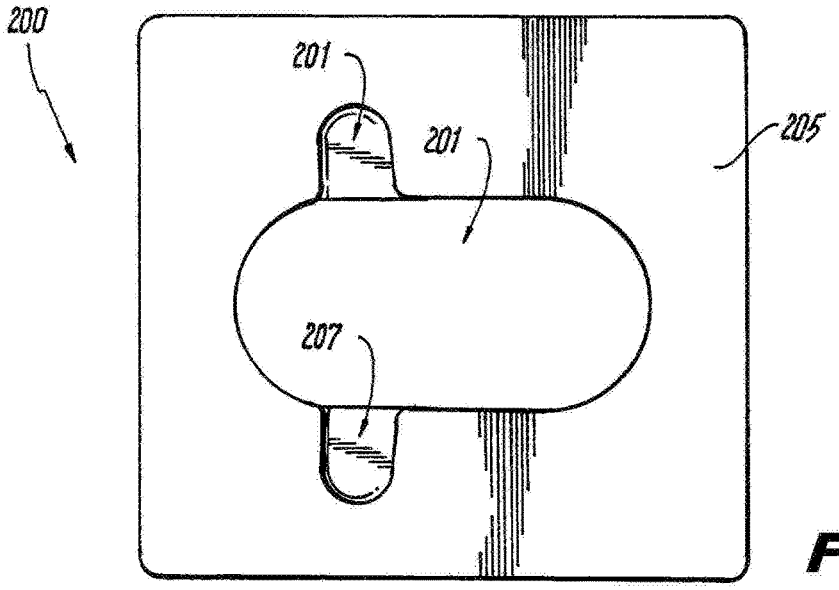
FIG. 2 is a plan view of an embodiment of an item of armor in accordance with this disclosure, shown having a central aperture and excess material in a smaller aperture extending therefrom after curing.
Figure 3:
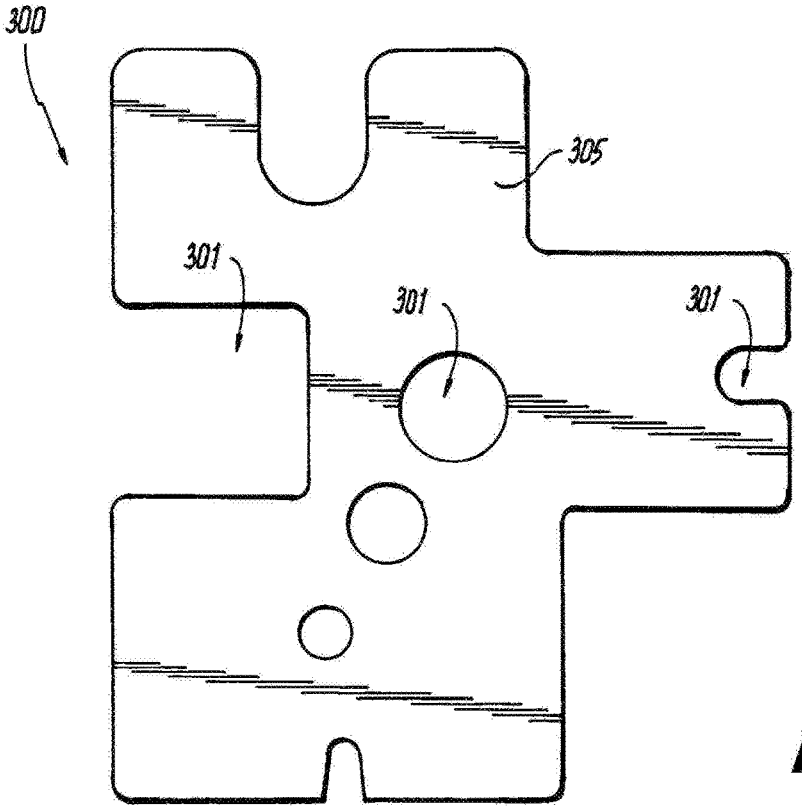
FIG. 3 is a plan view of an embodiment of an item of armor in accordance with this disclosure, shown having a plurality of apertures of varying size, shapes, and locations.

Referring to FIGS. 2 and 3, an item of armor 200, 300 can include one or more apertures 201, 301 (e.g., holes and/or recesses) defined in the first shell layer (not shown) and/or the second shell layer 205, 305 to correspond to one or more apertures defined in the ballistics arresting core 101. For example, the walls that form apertures of the ballistics arresting core 101 can be covered by the first shell layer (e.g., 103 as shown in FIG. 1B) and/or second shell layer 205, 305. In certain embodiments, the second shell layer 205, 305 can overlap the edge (e.g., edge 103*a*) of the first shell layer (e.g., 103*a*) within the aperture defined in the ballistics arresting core 101.

Referring again to FIG. 1, it is contemplated that the first shell layer 103 and/or the second shell layer 105 can include one or more exterior coatings. The exterior coatings include one or more of a non-skid coating or paint. Any other suitable coating is contemplated herein.

A method for manufacturing an item of armor (e.g., item 100, 200, 300) includes coating a first side 101*a* of a ballistics arresting core 101 with a first shell layer 103 to create a partially coated ballistics arresting core 101. The partially coated ballistics arresting core 101 can be placed in a vacuum bag, and the vacuum bag can be depressurized. The partially coated ballistics arresting core 101 in the depressurized vacuum bag can be cured (e.g., in an autoclave) to create a partially shelled ballistics arresting core 101 (e.g., core 101 with only the first shell layer 103 affixed thereto). The first shell layer 103 and/or the second shell layer 105 can be disposed on the core in any suitable manner (e.g., using wet layup, using pre-impregnated fiber).

The method further includes removing the partially shelled ballistics arresting core 101 from the vacuum bag, coating a second side 101*b* of the partially shelled ballistics arresting core 101 with a second shell layer 105 to create a fully coated ballistics arresting core 101, and placing the fully coated ballistics arresting core 101 in a vacuum bag. The method includes depressurizing the vacuum bag and curing the fully coated ballistics arresting core 101 in the depressurized vacuum bag to create a fully shelled ballistics arresting core 101 (e.g., as shown in FIGS. 1A and 1B).

Coating a second side of the partially shelled ballistics arresting core can include partially overlapping the first shell layer 103 with the second shell layer 105 along an edge 103*a* of the first shell layer 103 to seal the ballistics arresting core 101 within the first shell layer 103 and the second shell layer 105. Partially overlapping the first shell layer 103 can include overlapping the edge 103*a* of the first shell layer at a side 103*c* of the ballistics arresting core 101 and/or within an aperture defined in the ballistics arresting core 101 (e.g., as shown in FIGS. 2 and 3).

Coating the first shell layer 103 and/or second shell layer 105 can include using between two to six plies of material for the first shell layer and/or the second shell layer. In certain embodiments, each ply can be about 0.01 inches thick. Any other suitable number or thicknesses of plies of material is contemplated herein.

The method can include cutting or stamping one or more apertures in the first shell layer 103 and/or the second shell layer 105 to correspond to one or more apertures in the ballistics arresting core 101. For example, a hole can be cut in the first shell layer 103 and/or the second shell layer 105 that aligns with a hole in the ballistics arresting core 101. In certain embodiments, the is hole in the first shell layer 103 and/or the second shell layer can be smaller than a corresponding hole in the ballistics arresting core 101 such that there is sufficient material to cover at least a portion of the walls of the ballistics arresting core 101 that define the hole (e.g., such that the force of the depressurized vacuum bag presses the layer material into the hole to wrap the walls that define the hole).

In certain cases, there may be excess material (e.g., flash 207 as shown in FIG. 2) after one or more of the layers are cured. Therefore, the method can include trimming the first shell layer 103 after curing the partially coated ballistics arresting core 101. Similarly, in certain embodiments, the method can include trimming the second shell layer 105 after curing the fully coated ballistics arresting core 101. Trimming can include cutting, routing, polishing, sanding, or any other suitable process.

In certain embodiments, the method can include coating the first shell layer 103 and/or the second shell layer 105 with one or more exterior coatings. The exterior coatings can include one or more of a non-skid coating, paint, or any other suitable coating. Any other suitable preprocessing or post processing for any components as described above is contemplated herein.

Certain embodiments as described above include a composite wrapped armor system encapsulating an armor material in a composite shell. Non ballistic materials can also be incorporated into the shell for use as spacers, mounts, or for any other suitable use. Any suitable number of armor components (e.g., cores 101) can be within sealed within a single shell, or separate armor components (e.g. cores 101) can be placed in a secondary shell (e.g., such that there are alternating layers of shells and cores 101). Multiple items (e.g., 100, 200, 300) can be bonded together by an adhesive or mechanical fastening system to form any suitable armor system (e.g., configured to mount to helicopter or other aircraft). By way of example, aspects of this disclosure can be used in inside or as part of a structural system and/or armor system for any suitable vehicle (e.g., a rotorcraft, an airplane, a ground based vehicle).

As described above, embodiments of the method of manufacture are counterintuitive as multiple layup, cure, and/or trim and/or handling cycles for a single part, whereas traditional methods use only a single stage. The method as described above can allow complex items of armor (e.g., having apertures, mounts, etc.) to be formed. While embodiments of the method described above would appear to increase the time and material cost to make an item of armor, but can actually save time and cost on complex items.

Items of armor as described above provide an improved fluid barrier to separate the internal components for the surrounding environment, provide an improved impact resistance for the internal components, provide an improved structural support to the internal components (e.g., core 101), allow the incorporation of mounting features for one or more items of armor (e.g., for a vehicle armor system), provide increased ballistic performance (e.g., with reduced back deformation), and allows the use of the armor material as the forming tool. Certain embodiments allow for reduced manufacturing time and cost overall, especially for items of armor with complex geometry.

The methods and systems of the present disclosure, as described above and shown in the drawings, provide for improved items of armor with superior properties. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A method for manufacturing armor, comprising:

coating a first side of a ballistics arresting core with a first shell layer to create a partially coated ballistics arresting core;

placing the partially coated ballistics arresting core in a vacuum bag and depressurizing the vacuum bag;

curing the partially coated ballistics arresting core in the depressurized vacuum bag to create a partially shelled ballistics arresting core;

removing the partially shelled ballistics arresting core from the vacuum bag;

coating a second side of the partially shelled ballistics arresting core with a second shell layer to create a fully coated ballistics arresting core;

placing the fully coated ballistics arresting core in a vacuum bag and depressurizing the vacuum bag; and curing the fully coated ballistics arresting core in the depressurized vacuum bag to create a fully shelled ballistics arresting core.

2. The method of claim 1, wherein coating a second side of the partially shelled ballistics arresting core includes partially overlapping the first shell layer with the second shell layer along an edge of the first shell layer to seal the ballistics arresting core within the first shell layer and the second shell layer.

3. The method of claim 2, wherein partially overlapping the first shell layer includes overlapping the edge of the first shell layer at a side of the ballistics arresting core and/or within an aperture defined in the ballistics arresting core.

4. The method of claim 1, wherein coating the first shell layer and/or second shell layer includes using between two to six plies of material for the first shell layer and/or the second shell layer.

5. The method of claim 1, further comprising cutting or stamping one or more apertures in the first shell layer and/or the second shell layer to correspond to one or more apertures in the ballistics arresting core.

6. The method of claim 1, further comprising trimming the first shell layer after curing the partially coated ballistics arresting core.

7. The method of claim 1, further comprising trimming the second shell layer after curing
the fully coated ballistics arresting core.

8. The method of claim 1, wherein the first shell layer and/or the second shell layer include fiber reinforced polymer.

9. The method of claim 8, wherein the fiber reinforced polymer includes pre-impregnated carbon-fiber.

10. The method of claim 1, further comprising coating the first shell layer and/or the second shell layer with one or more exterior coatings.

11. The method of claim 10, wherein the exterior coatings include one or more of a non-skid coating or paint.

* * * * *